US009984561B1

(12) United States Patent
Swafford

(10) Patent No.: US 9,984,561 B1
(45) Date of Patent: May 29, 2018

(54) METHOD AND SYSTEM FOR REMOTE MODIFICATION OF INFORMATION FOR AN APPLIANCE ACTIVATION TRANSMISSION

(71) Applicant: GM GLOBAL TECHNOLOGY OPERATIONS LLC, Detroit, MI (US)

(72) Inventor: Randy L. Swafford, Chesterfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days. days.

(21) Appl. No.: 15/403,460

(22) Filed: Jan. 11, 2017

(51) Int. Cl.
*G08C 17/02* (2006.01)

(52) U.S. Cl.
CPC ..... *G08C 17/02* (2013.01); *G08C 2201/20* (2013.01); *G08C 2201/92* (2013.01)

(58) Field of Classification Search
CPC ..... G08C 17/02; G08C 2201/92
USPC ..... 340/4.2
See application file for complete search history.

(56) References Cited

U.S. PATENT DOCUMENTS

| | | | | |
|---|---|---|---|---|
| 7,161,466 | B2 | 1/2007 | Chuey | |
| 2010/0171588 | A1* | 7/2010 | Chutorash | G07C 9/00182 340/5.71 |
| 2013/0147616 | A1* | 6/2013 | Lambert | G07C 5/008 340/426.1 |
| 2015/0260529 | A1* | 9/2015 | Petersen | G01C 21/26 701/522 |

* cited by examiner

*Primary Examiner* — Vernal Brown

(57) ABSTRACT

A method to modify activation information operatively stored in a remote location, the activation information is configured to be transmitted in an activation transmission generated by an appliance control device of a vehicle for remote activation of one or more appliances, the information modification method conducted through the support of a modification module having aspects incorporated into a mobile computing device, server, and a telematics unit of the vehicle is herein presented. The method includes the steps of: receiving a command to modify the activation information at the mobile computing device; transmitting the command from the mobile computing device to the remotely located server; receiving the command at the server; transmitting the command from the server to the remotely located telematics unit; receiving the command at the telematics unit; and modifying, via the telematics unit, the activation information prior to access by the appliance control device.

17 Claims, 3 Drawing Sheets

METHOD AND SYSTEM FOR REMOTE MODIFICATION OF INFORMATION FOR AN APPLIANCE ACTIVATION TRANSMISSION

INTRODUCTION

Infrastructural appliances such as garage door openers, smart door locks, security gates, lighting systems, and alarms may be remotely operated from a control. This remote control broadcasts an activation transmission that the appliance can recognize. An example of these remote controls are programmable garage door openers integrated into a vehicle to provide convenience. However, these remote controls can turn into a liability if the vehicle is stolen. For example, a car thief may take the vehicle to the owner's home and gain access by activating its garage door opener. The thief can even further gain ease of access if the remote control is programmed to activate any security gates or lighting systems and deactivate any door locks or alarms. Events, all of which, may be done well before the vehicle owner has time to get back to their home and change their appliance settings. What is needed is a method and system for a vehicle owner to remotely modify the programming of their remote control so as to restrict appliance abilities.

SUMMARY

A method to modify activation information operatively stored in a remote location, the activation information is configured to be transmitted in an activation transmission generated by an appliance control device of a vehicle for remote activation of one or more appliances, the information modification method conducted through the support of a modification module having aspects incorporated into a mobile computing device, server, and a telematics unit of the vehicle is herein presented. The method includes the steps of: (a) receiving a command to modify the activation information at the mobile computing device, (b) transmitting the command from the mobile computing device to the remotely located server; (c) receiving the command at the server; (d) transmitting the command from the server to the remotely located telematics unit; (e) receiving the command at the telematics unit; and (f) modifying, via the telematics unit, the activation information prior to access by the appliance control device.

The method may further include the steps of: (g) providing a user account comprising one or more pieces of validating data; (h) after step (c), accessing the user account through the server; and (i) reviewing the validating data, through the server, to confirm vehicle accuracy. The appliances may be a garage door opener, mechanical barrier, door locking system, lighting system, alarm system, or temperature control system. The activation information may be represented as binary data comprising identifier information and coded key information. The coded key information may have a variable code configuration. The activation information may be stored in a telematics unit memory device and may include identifier information. As a result, the telematics unit performs the activation information modification portion of step (f) by adjusting the identifier information in the memory device. The activation information may otherwise be stored in a telematics unit memory device and comprises unique characteristics information. As a result, the telematics unit performs the activation information modification portion of step (f) by removing of the unique characteristics information from the memory device.

A system to modify activation information operatively stored in a remote location, the activation information configured to be transmitted in an activation transmission generated by an appliance control device of a vehicle for remote activation of one or more appliances is also presented herein. The system includes a mobile computing device, server, and telematics unit. The mobile computing device includes a front-end aspect of a modification module. The mobile computing device is configured to receive at least one command. The mobile computing device is further configured to communicate one or more data transmissions.

The server includes a backend aspect of the modification module. The server is configured to both receive and communicate one or more data transmissions. The telematics unit is located in the vehicle and includes a task-end aspect of the modification module. The telematics unit is configured to receive one or more data transmissions.

Moreover, the front-end aspect of the modification module is configured to receive a modification command to modify the activation information from the mobile computing device. The front-end aspect is further configured to collaborate with the mobile communicating device to transmit the modification command to the server. The backend aspect of the modification module is configured to receive the modification command from the mobile computing device. The backend aspect is further configured to collaborate with the server to transmit the modification command to the telematics unit. The task-end aspect of the modification module is configured to receive the modification command from the server. The task-end aspect is further configured to modify the activation information prior to access by the appliance control device.

A non-transitory and machine-readable medium having stored thereon a modification module of executable instructions is further presented herein. The modification module modifies activation information configured to be transmitted in an activation transmission generated by an appliance control device of a vehicle, which when the non-transitory and machine-readable medium is provided a mobile computing device, server, and telematics unit and aspects of which being executed by the mobile computing device, server, and telematics unit, causes the machines to orchestrate and perform the steps of: (a) receiving a command to modify the activation information at the mobile computing device, (b) transmitting the command from the mobile computing device to the server; (c) receiving the command at the server; (d) transmitting the command from the server to the telematics unit; (e) receiving the command at the telematics unit; and (f) modifying the activation information through the telematics unit.

BRIEF DESCRIPTION OF THE DRAWINGS

The disclosed examples will hereinafter be described in conjunction with the following drawing figures, wherein like numerals denote like elements, and wherein.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present system and/or method. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
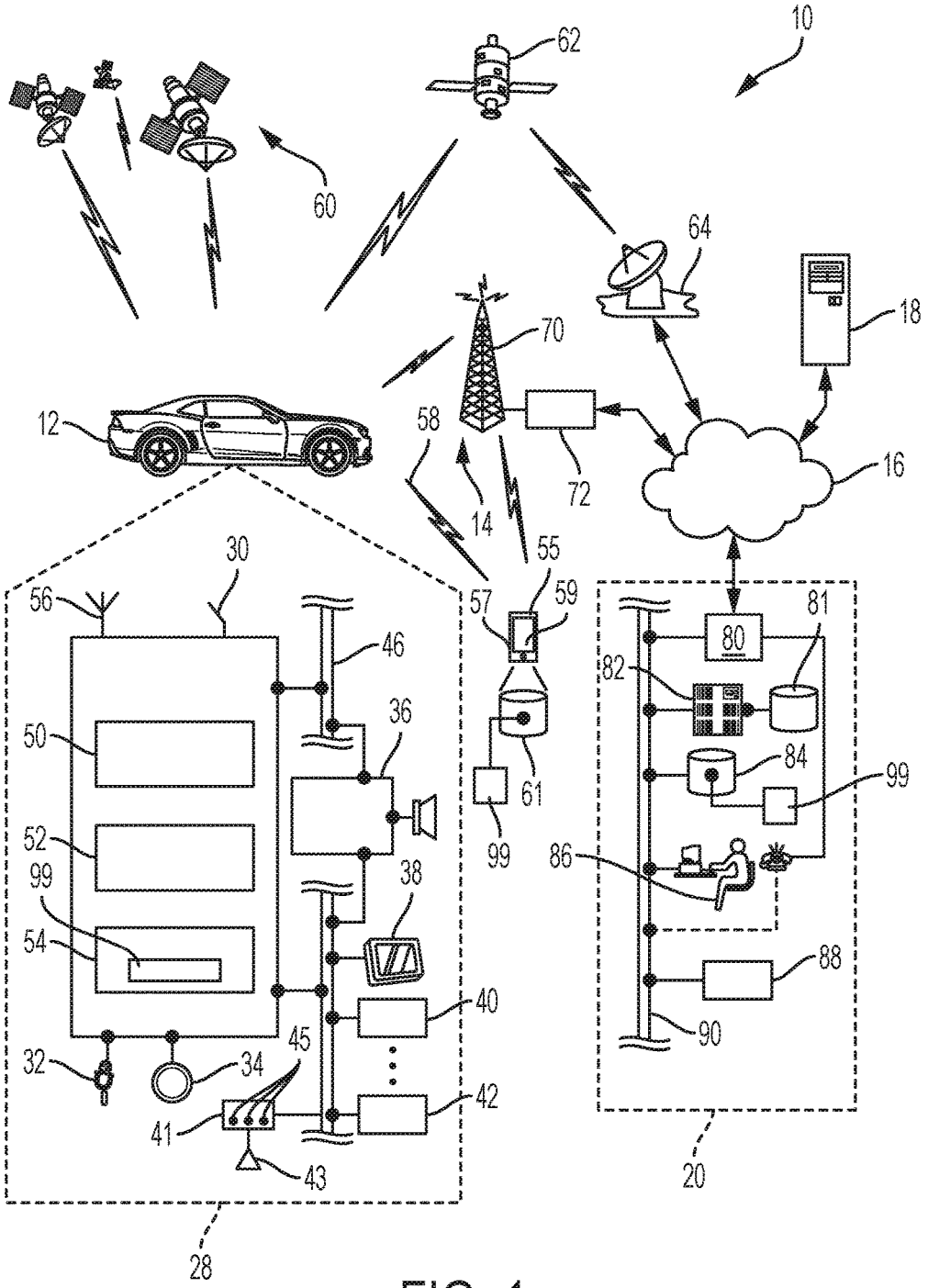
FIG. 1 is a block diagram depicting an exemplary embodiment of a communications system capable of utilizing the information modification system and method presented herein.

With reference to FIG. 1, there is shown an operating environment that includes, among other features, a mobile vehicle communications system 10 and that can be used to implement the method disclosed herein. Communications system 10 generally includes a vehicle 12, one or more wireless carrier systems 14, a land communications network 16, a computer 18, and a data center 20. It should be understood that the disclosed method can be used with any number of different systems and is not specifically limited to the operating environment shown here. Also, the architecture, construction, setup, and operation of the system 10 and its individual components are generally known in the art. Thus, the following paragraphs simply provide a brief overview of one such communications system 10; however, other systems not shown here could employ the disclosed method as well.

Vehicle 12 is depicted in the illustrated embodiment as a passenger car, but it should be appreciated that any other vehicle including, but not limited to, motorcycles, trucks, sports utility vehicles (SUVs), recreational vehicles (RVs), marine vessels (e.g., boats), aircraft, etc., can also be used. Some of the vehicle electronics 28 is shown generally in FIG. 1 and includes a telematics unit 30, a microphone 32, one or more pushbuttons or other control inputs 34, an audio system 36, a visual display 38, and a GPS module 40 as well as a number of vehicle system modules (VSMs) 42. Some of these devices can be connected directly to the telematics unit 30 such as, for example, the microphone 32 and pushbutton(s) 34, whereas others are indirectly connected using one or more network connections, such as a communications bus 44 or an entertainment bus 46. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

Telematics unit 30 can be an OEM-installed (embedded) or aftermarket device that is installed in the vehicle and that enables wireless voice and/or data communication over wireless carrier system 14 and via wireless networking. This enables the vehicle to communicate with data center 20, other telematics-enabled vehicles, or some other entity or device. The telematics unit 30 preferably uses radio transmissions to establish a communications channel (a voice channel and/or a data channel) with wireless carrier system 14 so that voice and/or data transmissions can be sent and received over the channel. By providing both voice and data communication, telematics unit 30 enables the vehicle to offer a number of different services including those related to navigation, telephony, emergency assistance, diagnostics, infotainment, etc. Data can be sent either via a data connection, such as via packet data transmission over a data channel, or via a voice channel using techniques known in the art. For combined services that involve both voice communication (e.g., with a live advisor 86 or voice response unit at the data center 20) and data communication (e.g., to provide GPS location data or vehicle diagnostic data to the data center 20), the system can utilize a single call over a voice channel and switch as needed between voice and data transmission over the voice channel, and this can be done using techniques known to those skilled in the art.

According to one embodiment, telematics unit 30 utilizes cellular communication according to standards such as GSM or CDMA and thus includes a standard cellular chipset 50 for voice communications like hands-free calling, a wireless modem for data transmission (i.e., transceiver), an electronic processing device 52, at least one digital memory device 54, and a dual antenna 56. It should be appreciated that the modem can either be implemented through software that is stored in the telematics unit and is executed by processor 52, or it can be a separate hardware component located internal or external to telematics unit 30. The modem can operate using any number of different standards or protocols such as EVDO, CDMA, GPRS, and EDGE. Wireless networking between vehicle 12 and other networked devices can also be carried out using telematics unit 30. For this purpose, telematics unit 30 can be configured to communicate wirelessly according to one or more wireless protocols, such as any of the IEEE 802.11 protocols, WiMAX, or Bluetooth. When used for packet-switched data communication such as TCP/IP, the telematics unit can be configured with a static IP address or can set up to automatically receive an assigned IP address from another device on the network such as a router or from a network address server.

One of the networked devices that can communicate with the telematics unit 30 is a mobile computing device 57, such as a smart phone, personal laptop computer, smart wearable device, or tablet computer having two-way communication capabilities, a netbook computer, or any suitable combinations thereof. The mobile computing device 57 can include computer processing capability, a transceiver capable of communicating with wireless carrier system 14, a user interface 59, and/or a GPS module capable of receiving GPS satellite signals and generating GPS coordinates based on those signals. User interface 59 may be embodied as a touch-screen graphical interface capable of user interaction as well as displaying information. Examples of the mobile computing device 57 include the iPhone™ manufactured by Apple, Inc. and the Droid™ manufactured by Motorola, Inc. as well as others. While the mobile computing device 57 may include the ability to communicate via cellular communications using the wireless carrier system 14, this is not always the case. For instance, Apple manufactures devices such as the various models of the iPad™ and iPod Touch™ that include the processing capability, interface 59, and the ability to communicate over a short-range wireless communication link. However, the iPod Touch™ and some iPads™ do not have cellular communication capabilities. Even so, these and other similar devices may be used or considered a type of wireless device, such as the mobile computing device 57, for the purposes of the method described herein.

Mobile device 57 may be used inside or outside of vehicle 12, and may be coupled to the vehicle by wire or wirelessly. The mobile device also may be configured to provide services according to a subscription agreement with a third-party facility or wireless/telephone service provider. It should be appreciated that various service providers may utilize the wireless carrier system 14 and that the service provider of the telematics unit 30 may not necessarily be the same as the service provider of the mobile devices 57. When using a short-range wireless connection (SRWC) protocol (e.g., Bluetooth/Bluetooth Low Energy or Wi-Fi), mobile computing device 57 and telematics unit 30 may pair/link one with another, and thus become bonded, when within a wireless range (e.g., prior to experiencing a disconnection from the wireless network)—as is generally known to skilled artisans.

Telematics Controller 52 can be any type of device capable of processing electronic instructions including microprocessors, microcontrollers, host processors, controllers, vehicle communication processors, and application specific integrated circuits (ASICs). It can be a dedicated processor used only for telematics unit 30 or can be shared with other vehicle systems. Telematics Controller 52 executes various types of digitally-stored instructions, such as software modules made (e.g., modification module 99) or firmware programs stored in memory 54, which enable the telematics unit to provide a wide variety of services. For instance, controller 52 can execute programs or process data to carry out at least a portion of the method discussed herein.

Telematics unit 30 can be used to provide a diverse range of vehicle services that involve wireless communication to and/or from the vehicle. Such services include: turn-by-turn directions and other navigation-related services that are provided in conjunction with the GPS-based vehicle navigation module 40; airbag deployment notification and other emergency or roadside assistance-related services provided in connection with one or more vehicle system modules 42 (VSM); diagnostic reporting using one or more diagnostic modules; and infotainment-related services where music, webpages, movies, television programs, videogames and/or other information is downloaded by an infotainment module (not shown) and is stored for current or later playback. The above-listed services are by no means an exhaustive list of all of the capabilities of telematics unit 30, but are simply an enumeration of some of the services that the telematics unit 30 is capable of offering. Furthermore, it should be understood that at least some of the aforementioned modules could be implemented in the form of software instructions (executable segments of code) saved internal or external to telematics unit 30, they could be hardware components located internal or external to telematics unit 30, or they could be integrated and/or shared with each other or with other systems located throughout the vehicle, to cite but a few possibilities. In the event that the modules are implemented as VSMs 42 located external to telematics unit 30, they could utilize vehicle bus 44 to exchange data and commands with the telematics unit.

GPS module 40 receives radio signals from a constellation 60 of GPS satellites. From these signals, the module 40 can determine vehicle position that is used for providing navigation and other position-related services to the vehicle driver. Navigation information can be presented on the display 38 (or other display within the vehicle) or can be presented verbally such as is done when supplying turn-by-turn navigation. The navigation services can be provided using a dedicated in-vehicle navigation module (which can be part of GPS module 40), or some or all navigation services can be done via telematics unit 30, wherein the position information is sent to a remote location for purposes of providing the vehicle with navigation maps, map annotations (points of interest, restaurants, etc.), route calculations, and the like. The position information can be supplied to data center 20 or other remote computer system, such as computer 18, for other purposes, such as fleet management. Also, new or updated map data can be downloaded to the GPS module 40 from the data center 20 via the telematics unit 30.

Apart from the audio system 36 and GPS module 40, the vehicle 12 can include other VSMs 42 in the form of electronic hardware components located throughout the vehicle and typically receive input from one or more sensors and use the sensed input to perform diagnostic, monitoring, control, reporting and/or other functions. Each of the VSMs 42 is preferably connected by communications bus 44 to the other VSMs, as well as to the telematics unit 30, and can be programmed to run vehicle system and subsystem diagnostic tests.

As examples, one VSM 42 can be an engine control module (ECM) that controls various aspects of engine operation such as fuel ignition and ignition timing, another VSM 42 can be a powertrain control module that regulates operation of one or more components of the vehicle powertrain, and another VSM 42 can be a body control module (BCM) that governs various electrical components located throughout the vehicle, like the vehicle's power door locks, headlights, and an appliance control device 41. According to one embodiment, the engine control module is equipped with on-board diagnostic (OBD) features that provide myriad real-time data, such as that received from various sensors including vehicle emissions sensors, and provide a standardized series of diagnostic trouble codes (DTCs) that allow a technician to rapidly identify and remedy malfunctions within the vehicle. As is appreciated by those skilled in the art, the above-mentioned VSMs are only examples of some of the modules that may be used in vehicle 12, as numerous others are also possible.

Vehicle electronics 28 also includes a number of vehicle user interfaces that provide vehicle occupants with a means of providing and/or receiving information, including microphone 32, pushbuttons(s) 34, audio system 36, visual display 38, and programmable appliance control device 41. As used herein, the term 'vehicle user interface' broadly includes any suitable form of electronic device, including both hardware and software components, which is located on the vehicle and enables a vehicle user to communicate with or through a component of the vehicle. Microphone 32 provides audio input to the telematics unit to enable the driver or other occupant to provide voice commands and carry out hands-free calling via the wireless carrier system 14. For this purpose, it can be connected to an on-board automated voice processing unit utilizing human-machine interface (HMI) technology known in the art.

The pushbutton(s) 34 allow manual user input into the telematics unit 30 to initiate wireless telephone calls and provide other data, response, or control input. Separate pushbuttons can be used for initiating emergency calls versus regular service assistance calls to the data center 20. Audio system 36 provides audio output to a vehicle occupant and can be a dedicated, stand-alone system or part of the primary vehicle audio system. According to the particular embodiment shown here, audio system 36 is operatively coupled to both vehicle bus 44 and entertainment bus 46 and can provide AM, FM, media streaming services (e.g., PANDORA RADIO™, SPODIFY™, etc.), satellite radio, CD, DVD and other multimedia functionality. This functionality can be provided in conjunction with or independent of the infotainment module described above. Visual display 38 is preferably a graphics display, such as a touch screen on the instrument panel or a heads-up display reflected off of the windshield, and can be used to provide a multitude of input and output functions (i.e., capable of GUI implementation). Audio system 36 may also generate at least one audio notification to announce such third-party contact information is being exhibited on display 38 and/or may generate an audio notification which independently announces the third-party contact information. Various other vehicle user interfaces can also be utilized, as the interfaces of FIG. 1 are only an example of one particular implementation.

Appliance control device 41 can be mounted in the vehicle interior or may be part of a removable keyless entry fob (not shown). Control 41 may be connected to telematics unit 30 via the vehicle bus 44 or via an RF transmitting device such as, but not limited to, control antenna 43. As a result, telematics unit 30 can operate one or more features of control 41. In turn, control 41 can operatively access features of telematics unit 30 such as, but not limited to, digital memory device 54. This control may be direct via vehicle bus 44 or antenna 43 or it may be conducted indirectly via one or more VSMs 42 (e.g., BCM).

The control device 41 can communicate wirelessly with a remote controlled appliance. Control 41 may include one or more operational switches 45 (e.g., buttons) for device operation or programming. These switches 45 may be mounted within a vehicle instrument panel, a visor, other vehicle interior areas, or they may be virtual and shown on visual display 38 (e.g., via GUI implementation). For example, control device 41 may be a Universal Garage Door Opener module (UGDO) that can be controlled through virtual prompts exhibited by the HMI module shown on virtual display 38. In this example, the remote controlled appliance would be a Garage Door Opener (GDO) installed in a garage. Control device 41 is well known in the art and may further be similar in structure, function, and/or operation of the universal garage door opener systems described in U.S. Pat. No. 7,489,922 and U.S. Pat. No. 7,161,466, both of which being herein incorporated by reference. It should be understood that the HMI module is a GUI exhibited through display 38 for the purpose of enabling various control aspects of telematics unit 30.

Wireless carrier system 14 is preferably a cellular telephone system that includes a plurality of cell towers 70 (only one shown), one or more mobile switching centers (MSCs) 72, as well as any other networking components required to connect wireless carrier system 14 with land network 16. Each cell tower 70 includes sending and receiving antennas and a base station, with the base stations from different cell towers being connected to the MSC 72 either directly or via intermediary equipment such as a base station controller. Cellular system 14 can implement any suitable communications technology, including for example, analog technologies such as AMPS, or the newer digital technologies such as CDMA (e.g., CDMA2000 or 1×EV-DO) or GSM/GPRS (e.g., 4G LTE). As will be appreciated by skilled artisans, various cell tower/base station/MSC arrangements are possible and could be used with wireless system 14. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 14, a different wireless carrier system in the form of satellite communication can be used to provide uni-directional or bi-directional communication with the vehicle. This can be done using one or more communication satellites 62 and an uplink transmitting station 64. Uni-directional communication can be, for example, satellite radio services, wherein programming content (news, music, etc.) is received by transmitting station 64, packaged for upload, and then sent to the satellite 62, which broadcasts the programming to subscribers. Bi-directional communication can be, for example, satellite telephony services using satellite 62 to relay telephone communications between the vehicle 12 and station 64. If used, this satellite telephony can be utilized either in addition to or in lieu of wireless carrier system 14.

Land network 16 may be a conventional land-based telecommunications network that is connected to one or more landline telephones and connects wireless carrier system 14 to data center 20. For example, land network 16 may include a public switched telephone network (PSTN) such as that used to provide hardwired telephony, packet-switched data communications, and the Internet infrastructure (i.e., a network of interconnected computing device nodes). One or more segments of land network 16 could be implemented through the use of a standard wired network, a fiber or other optical network, a cable network, power lines, other wireless networks such as wireless local area networks (WLANs), or networks providing broadband wireless access (BWA), or any combination thereof. Furthermore, data center 20 need not be connected via land network 16, but could include wireless telephony equipment so that it can communicate directly with a wireless network, such as wireless carrier system 14.

Computer 18 can be one of a number of computers accessible via a private or public network such as the Internet. Each such computer 18 can be used for one or more purposes, such as a web server accessible by the vehicle via telematics unit 30 and wireless carrier 14. Other such accessible computers 18 can be, for example: a service center computer where diagnostic information and other vehicle data can be uploaded from the vehicle via the telematics unit 30; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with the vehicle 12 or data center 20, or both. A computer 18 can also be used for providing Internet connectivity such as DNS services or as a network address server that uses DHCP or other suitable protocol to assign an IP address to the vehicle 12.

Data center 20 is designed to provide the vehicle electronics 28 with a number of different system backend functions and, according to the exemplary embodiment shown here, generally includes one or more switches 80, servers 82, databases 84, live advisors 86, as well as an automated voice response system (VRS) 88, all of which are known in the art. These various data center components are preferably coupled to one another via a wired or wireless local area network 90. Switch 80, which can be a private branch exchange (PBX) switch, routes incoming signals so that voice transmissions are usually sent to either the live adviser 86 by regular phone, backend computer 87, or to the automated voice response system 88 using VoIP. Server 82 can incorporate a data controller 81 which essentially controls the operations of server 82. Server 82 may control data information as well as act as a transceiver to send and/or receive the data information (i.e., data transmissions) from one or more of the databases 84, telematics unit 30, and mobile computing device 57.

Controller 81 is capable of reading executable software instructions stored in a non-transitory machine readable medium and may include one or more from among a processor, a microprocessor, a central processing unit (CPU), a graphics processor, Application Specific Integrated Circuits (ASICs), Field-Programmable Gate Arrays (FPGAs), state machines, and a combination of hardware, software and firmware components. The live advisor phone can also use VoIP as indicated by the broken line in FIG. 1. VoIP and other data communication through the switch 80 is implemented via a modem (i.e., a transceiver), connected between the land communications network 16 and local area network 90. Data transmissions are passed via the modem to server 82 and/or database 84. Data transmissions may also be conducted by wireless systems, such as 802.11x, GPRS, and the like. Although the illustrated embodiment has been described as it would be used in conjunction with a manned data center 20 using live advisor 86, it will be appreciated that the data center can instead utilize VRS 88 as an automated advisor or, a combination of VRS 88 and the live advisor 86 can be used.

Database 84 can store account information such as vehicle dynamics information and other pertinent subscriber information. Database 84 could be designed to hold vehicle records such as, but not limited to, telematics account records containing certain aspects of user preference information. This backend (host-side) information being stored and generated could moreover be written in SQL (structured query language). One embodiment of the backend information may be created such that each record is organized through a tabular form (spreadsheet).

For example, the user of mobile computing device 57 may create their own vehicle user account ("user account") that can be organized into or collaborate with a backend aspect of a activation information modification software module 99 ("modification module"), both of which are stored in database 56. The user may perform tasks to create this user account through a front-end aspect of the modification module 99 which may be installed onto a variety of devices such as, but not limited to, remote computer 18 and mobile computing device 57 or through live advisor 86 at data center 20. The user account and module backend may be accessible on server 82 (i.e., to support backend functions and to install software upgrades). Data center 20 may also access one or more additional remote servers and/or remote databases (e.g., Department of Motor Vehicles databases) to receive information in support of the user account.

The user account may include validating data to verify and/or validate that future login attempts are secure (e.g., granting access only to the user). The validating data may include an account username and account password as well as user information (e.g., driver's license number), mobile computing device information such as, for example, the unique mobile device identifier (i.e., mobile serial number). The user account may additionally store a variety of user preferences.

The mobile computing device 57 may receive the front-end aspect of modification module 99. To install the module on mobile device 57, for example, the user may visit an online software module store or web-service (not shown) and download this aspect of modification module 99 therefrom. The mobile computing device 57 may moreover install this aspect of the modification module 99 onto mobile memory 61. Modification module 99 may moreover include one or more graphical user interfaces (GUIs) to be exhibited through display 59, and which include one or more prompts to instruct the user to provide information (e.g., validating data) to support user account creation as well as enable other aspects of module functionality.

Mobile computing device 57 with the installed front-end aspect of modification module 99 may be validated by the data center 20 to ensure an authentic association between mobile computing device 57 and vehicle 12. For example, having downloaded modification module 99, the user of the mobile computing device 57 may provide the same validating data into modification module 99 already provided to the data center 20. The data center 20 may receive the validating data and verify that the password is associated with the username; further, the data center also may confirm that the mobile computing device 57 remains to be associated with vehicle 12 and/or the user's account. Mobile computing device 57 may also automatically provide the unique mobile device identifier (e.g., mobile serial number) to the data center 20, and this identifier may be compared to various data provided to data center 20 to confirm the association remains intact.

Based upon the association confirmation, data center 20 may require further information of the association between mobile computing device 57 and vehicle 12 and/or the user's account by sending a challenge message to a task-end aspect of modification module 99 installed on telematics unit 30 (to be completed by the user). After the task-end aspects of modification module 99 receives the challenge message, telematics unit 30 may generate a challenge or a query (e.g., a nonce challenge) to further safeguard against malicious dealings with vehicle 12. When the telematics unit 30 receives the challenge message (i.e., via visual display 38), it may transmit a response message back to data center 20. The response message may include the answer and/or response to the challenge (e.g., username and password, personal credentials, etc.).

Having validated mobile computing device 57, the mobile device may access the backend aspects of modification module 99 and configure at least one telematics unit parameter (e.g., a software setting) to grant mobile device 57 control over certain features of telematics unit 30 (e.g., enabling remote commands). The task-end aspects of modification module 99 may alternatively be accessed via the front-end aspects of modification module 99 being installed onto computer 18. It should be appreciated that this data transmission routes first to the backend aspects of modification module 99 at data center 20 to cause data center 20 to act as an automated relaying device that can automatically transmit or retransmit the request or command to the task-end aspect of modification module 99. Once the request or command is received, telematics unit 30 may act as a slave device for at least the purposes of adequately completing one or more task-end aspects of modification module 99.

Figure 2:
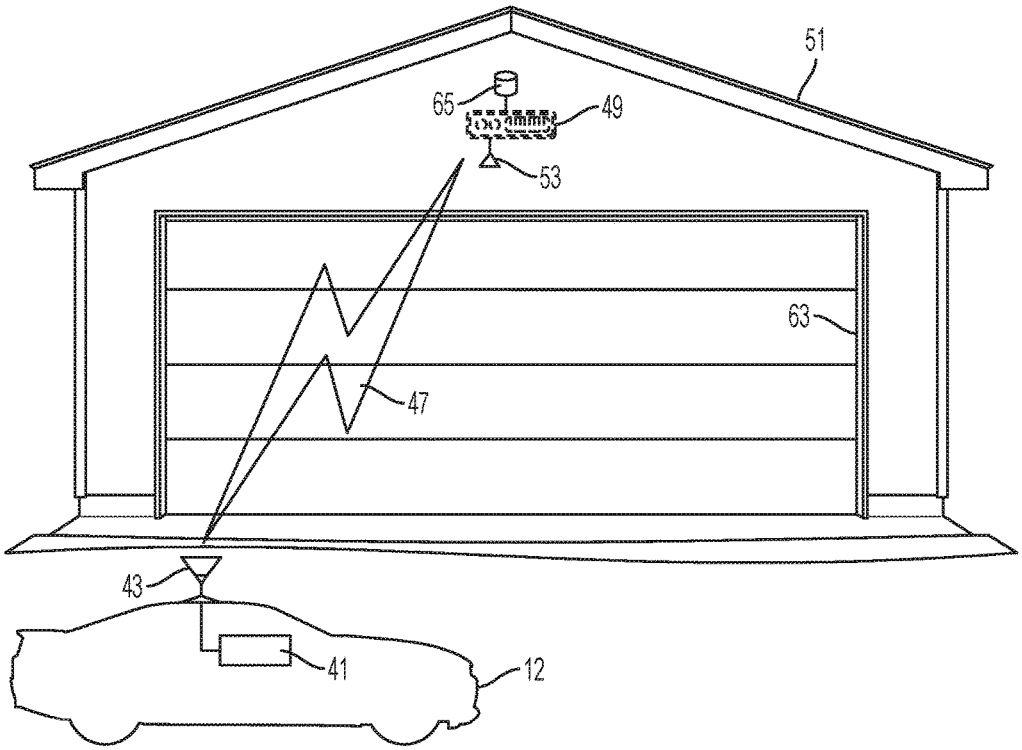
FIG. 2 is an environmental diagram illustrating an application of an exemplary appliance control according to an aspect of the information modification system and method presented herein.

Referring now to FIG. 2, as discussed above, control device 41 allows one or more appliances 49 to be remotely controlled using control transceiver 43. In the example shown, activation transmission 47 is received by and operates a garage door opener 49 (GDO) of garage 51. Control antenna thus generates and transmits preprogrammed data in response to a user depressing an activation switch 45. A GDO receiver 53 subsequently receives the transmission 47 and, in turn, controls the GDO to open/close the garage door 63. Programmable control device 41 is mounted in vehicle 12 in this embodiment. Control 41 may, however, be embodied as being hand-held which would include being located in a key fob or the like. It should be understood that appliance control 41 may also be programmed to control a wide variety of appliances 49 such as, but not limited to, mechanical barriers (e.g., gating systems), door locking systems, lighting systems (e.g., facility lighting, street or compound lighting), alarm systems, and temperature control systems.

When a user of programmable control device 41 wishes to open door 63, the user may operate control 41 to cause control transceiver 43 to generate an activation transmission 47 having data characteristics appropriate to connect with and activate GDO 49. Information transmitted in these activation transmissions 47 may be represented as binary, data which may moreover include one or more fields such as, but not limited to, identifier information and a coded key information. The identifier information uniquely identifies control device 41 and/or control transceiver 43 and it may be a static or dynamic serial number made up of the binary equivalent of integers (e.g., 0-9) and/or characters (e.g., A-Z). The coded key information helps to prevent unwanted activation and unauthorized access of COO 49. The identifier information and key information may be stored in digital memory device 54 or database 84, and the identifier information may be further modified by telematics unit 30. It should be understood that certain applications of device control may use an activation transmission 47 represented by data other than binary/base2 (e.g., base10, base3, base8, etc).

Several types of coded key embodiments may be generated by programmable control device 41. When the coded key may have a fixed code configuration, for instance, each transmission of the coded key contains the same binary pattern. In contrast, when the coded key may have a variable code configuration, for instance, the binary bit pattern changes with each activation transmission 47. The most common variable code scheme, a rolling code scheme, is configured to generate key information by encrypting a synchronization (sync) counter value. After each data transmission 47, the counter is incremented. The encryption technique may also be such that a sequence of encrypted counter values appears to be random numbers.

To program control device 41 to generate the preprogrammed activation transmission 47, appliance control 41 will generate a sequence of preliminary beacon signals 47 each implementing an activation scheme that could possibly be associated with GDO receiver 53. When one of these activation schemes matches the appropriate unique characteristics being stored in a GDO memory 65, GDO 49 will store the scheme appropriately and a sensor (not shown) may generate a notification to indicate a match has been made.

In response, appliance control 41 will determine which beacon signal activated GDO 51. Control device 41 then stores data representing the correct beacon signal and activation scheme in digital memory device 54 as learned characteristics information and may associate this information with one of the activation switch 45. As a result, when control device 41 receives the proper command, control 41 retrieves the learned characteristics information and subsequently generates at least one transmission 47. Another exemplary embodiment of control device 41 would include its own memory device (not shown) to store the unique characteristics information. In such an embodiment, the memory can be accessible by other vehicle features (e.g., telematics unit 30) through, for example, vehicle bus 44. In yet another exemplary embodiment, the unique characteristics information is stored in database 84. In this embodiment, the characteristics information can be accessed by telematics unit 30 via wireless carrier system 14 or satellites 60.

When the GDO receiver 53 receives transmission 47 having the appropriate characteristics, receiver 53 will extract the identifier information and compare the information with all identifier information (activation schemes) in GDO memory 65. If no match is found, the receiver rejects or completely ignores the activation transmission 47. If a match is found, the GDO receiver 53 retrieves a stored crypt key associated with the received identifier information and decrypts the coded key information from the received transmission 47 to produce the sync counter value. If the received sync counter value matches that of the counter value information associated with the identifier information, activation proceeds and a connection is set between transceiver 43 and GDO receiver 53. The received sync counter value may also exceed the stored counter information associated with the identifier information by a specific preset amount for a successful activation and connection—more detailed descriptions of the above programmable control device operations are disclosed in U.S. Pat. No. 7,489,922 and U.S. Pat. No. 7,161,466 (previously incorporated by reference above).

Method

Figure 3:
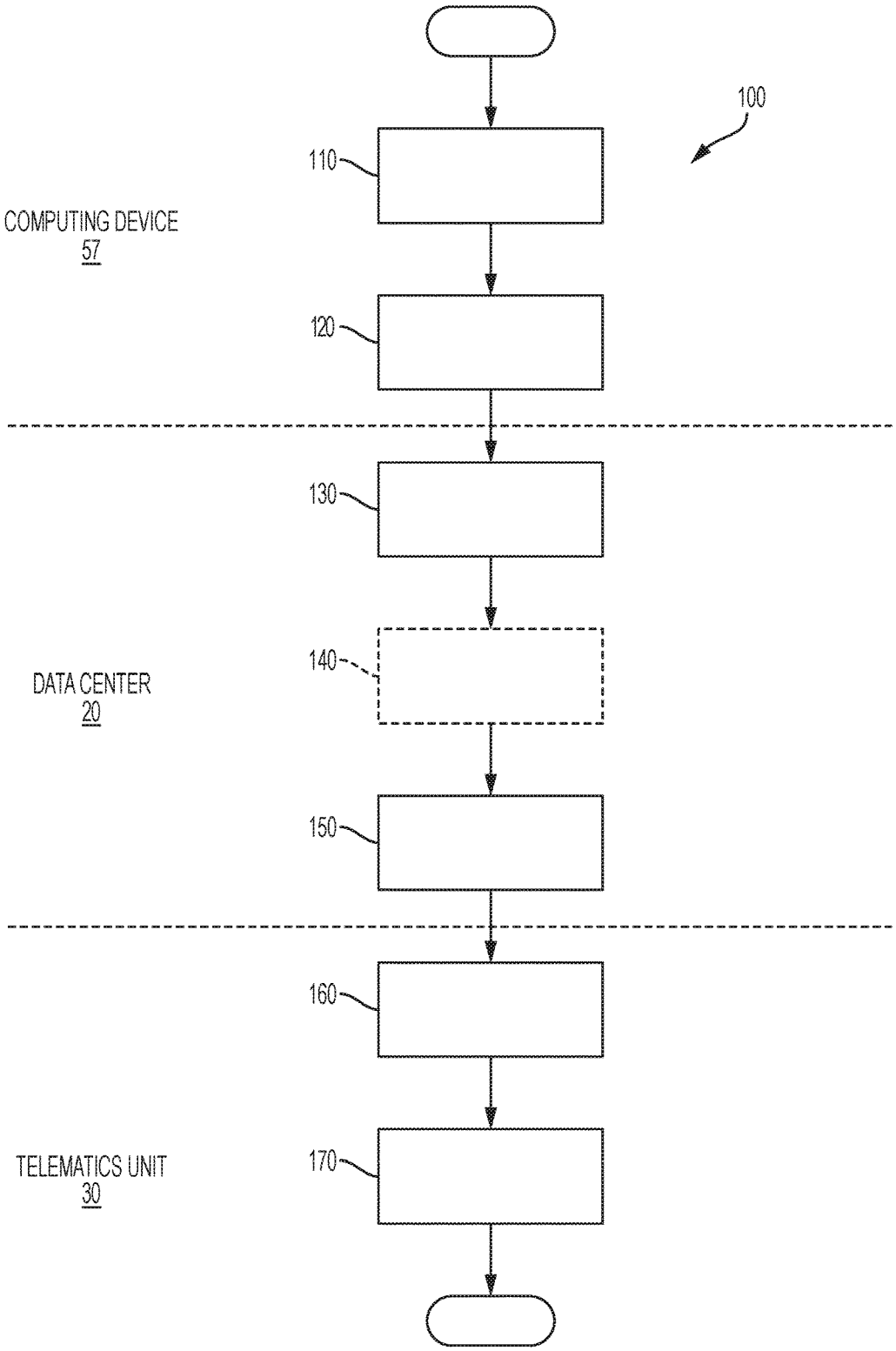
FIG. 3 is an exemplary flow according to an aspect of the information modification method presented herein.

Now turning to FIG. 3, there is shown an embodiment of a method 100 to activate modification module 99 for remotely erasing programmable control device information. One or more phases of modification module 99 may be completed through the task-end aspect of modification module 99 being implemented by controller 52 which may include one or more executable instructions incorporated into memory 54 and executed by of telematics unit 30 and antenna 56. One or more phases of method 300 may also, for example, be completed through the backend aspect of modification module 99 being implemented by server 82 of data center 20 which may include one or more executable instructions incorporated into data base 81. One or more phases of method 300 may otherwise, for example, be completed through the front-end aspect of modification module 99 being implemented by processing capability of mobile computing device 57 which may include one or more executable instructions incorporated into mobile memory 61. It should be understood that each aspect of modification module 99 orchestrates with the other aspects to act as a single entity for the purpose of controlling one or more machines (e.g., telematics unit 30) so as to provide myriad functionalities such as, but not limited to, modification of identifier information and characteristics data (discussed below). It should also be understood that each aspect of modification module 99 may be incorporated into another software module or it may collaborate with another software module (e.g., a broad-based telematics controlling module). Skilled artisans will moreover see that telematics unit 30, data center 20, and mobile computing device 57 may be remotely located from each other.

Method 100 is supported by telematics unit 30 being configured to incorporate the task-end aspects of modification module 99. This configuration may be made by a vehicle manufacturer at or around the time of the telematics unit's assembly or after-market (e.g., via vehicle download using the afore-described communication system 10 or at a time of vehicle service, just to name a couple of examples).

In at least one implementation, one or more instructions are provided to the telematics unit 30 and stored on non-transitory computer-readable medium (e.g., on memory device 54). Method 100 is further supported by preconfiguring data center 20 to store the backend aspects of modification module 99 as well as one or more user accounts in database 84, each of which being accessible via server 82. Method 100 is further yet supported by preconfiguring mobile computing device 57 to store the front-end aspects of modification module 99.

Method 100 begins in a first phase which occurs at mobile computing device 57 and through the front-end aspect of modification module 99. The method optionally includes a precursory step (not shown) in which telematics unit 30 establishes data communications with data center 20 to subsequently allow for the transmission of data with data center 20. In step 110, a command to modify the activation information is made to the mobile computing device 57. This command may be made through interface 59 and should be made when modification module 99 is active on the device. In this way, the command may be prompted through a virtual prompt displayed through at least one GUI of modification module 99. In step 120, modification module 99 manipulates mobile computing device 57 by causing it to access its transceiver. Once accessed, modification module 99 causes this modification command to be transmitted over to data center 20. This transmission may moreover be conducted over the wireless carrier systems 14, through communication satellites 62, or land communications network 16.

In step 130, method 100 moves to a second phase which occurs at data center 20 and through the backend aspect of modification module 99. In this step, moreover, the modification command is received at data center 20 by server 82. Server 82 may then access the validating data of the user account determined to correspond with the mobile computing device 57, in optional step 140. The backend aspect of modification module 99 may then review the validating data to accurately confirm which vehicle 12 in the system is associated with the user of mobile computing device 57. Upon the correct vehicle being confirmed, in step 150, modification module 99 manipulates server 82 by causing it to transmit the modification command over to the telematics unit 30 of the accurate vehicle 12. This transmission may be conducted over the wireless carrier systems 14 or communication satellites 62.

In step 160, method 100 moves to a third phase which occurs at telematics unit 30 and through the task-end aspect of modification module 99. In this step, moreover, the modification command is received at telematics unit 30 of the accurate vehicle 12. In step 170, telematics unit 30 modifies the activation information, which should occur prior to the appliance control device requiring to generate and send an activation transmission 47. Upon the activation information being modified, telematics unit 30 may be configured to exhibit a notification on visual display 38 to state, for example, that a modification to the functionality of appliance control device 41 has occurred.

In one exemplary embodiment of method 100, the information modification may occur when the identifier information is adjusted in memory 54 (or a memory integrated into appliance control 41). For example, telematics unit 30 may change the dynamic serial number (generating a new set of binary data) such that GDO 51 would not be able to make a proper match after receiving an activation transmission 47 and would thus reject the signal as being inaccurate. In this way, telematics unit 30 enhances the functionality of appliance control device 41 by prohibiting it from activating GDO 49 (or any other appliance) after the modification has been made. It should be appreciated that this improvement is made to computer-related technology by a required set of instructions that are sent over a network—due to the user of modification module 99 being remotely located from vehicle 12. In this manner, with such modifications being made to memory 54 or the like, it should also be appreciated that modification module 99 is necessarily rooted in computer technology (e.g., telematics unit 30).

In another exemplary embodiment, the information modification may occur when the unique characteristics information is completely removed from memory 54 or a memory integrated into control device 41. For example, telematics unit 30 may erase the data representation of the unique characteristics information in memory 54 or command control device 41 to erase characteristics information from its memory or both memories are erased in these ways. GDO 49 would not then be able to recognize that a transmission has been broadcasted by application control device 41 and thus would not begin the processes to determine if an activation should be made. In this way, telematics unit 30 enhances the functionality of appliance control device 41 by making its signals unrecognizable by GDO 49 (or any other appliance) for the purposes of activation. It should be appreciated that this improvement is made to computer-related technology by a required set of instructions that are sent over a network—due to the user of modification module 99 being remotely located from vehicle 12. In this manner, due to such modifications being made to memory 54 or the like, it should also be appreciated that modification module 99 is necessarily rooted in computer technology (e.g., telematics unit 30).

In a further exemplary embodiment of method 100, the information modification may occur when the HMI module is adjusted in memory 54 to exhibit different information. For example, the task-end aspect of modification module may collaborate with the HMI module to remove all virtual prompts 45 associated with control device 41 from being displayed, such that a user cannot make a command. As such, generation of an activation transmission 47 would thus be inaccessible by a vehicle user. In this way, telematics unit 30 enhances the functionality of appliance control device 41 by prohibiting the HMI module from enabling an activation of GDO 49 (or any other appliance) upon the modification being completed. It should be appreciated that this improvement is made to computer-related technology by a required set of instructions that are sent over a network—due to the user of modification module 99 being remotely located from vehicle 12. In this manner, with such modifications being made to memory 54 or the like, it should also be appreciated that modification module 99 is necessarily rooted in computer technology (e.g., telematics unit 30).

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the system and/or method that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A method to modify activation information operatively stored in a remote location, the information modification method conducted through a modification module having aspects incorporated into a mobile computing device, server, and a telematics unit of the vehicle, the telematics unit comprising an HMI module shown on a virtual display, the method comprising:

(a) receiving a command to modify activation information at the mobile computing device via a front-end aspect of a modification module, wherein the activation information is configured to be transmitted in an activation transmission generated by an appliance control device of a vehicle for remote activation of one or more appliances;

(b) transmitting the command from the mobile computing device to the remotely located server;

(c) receiving the command at a backend aspect of the modification module at the server;

(d) transmitting the command from the server to the remotely located telematics unit;

(e) receiving the command at a task-end aspect of the modification module at the telematics unit;

(f) modifying, via a task-end aspect of the modification module at the telematics unit, the activation information prior to access by the appliance control device; and (g) collaborating with the HMI module, via a task-end aspect of the modification module at the telematics unit, to remove one or more virtual prompts associated with the appliance control device from being displayed via the virtual display.

2. The method of claim 1, further comprising:

(g) providing a user account comprising one or more pieces of validating data;

(h) after step (c), accessing the user account through the backend aspect of the modification module at the server; and (i) reviewing the validating data, through the backend aspect of the modification module at the server, to confirm vehicle accuracy.

3. The method of claim 1, wherein the one or more appliances can be a garage door opener, mechanical barrier, door locking system, lighting system, alarm system, or temperature control system.

4. The method of claim 1, wherein the activation information is represented as binary data comprising identifier information and coded key information.

5. The method of claim 3, wherein the coded key information has a variable code configuration.

6. The method of claim 1, wherein:

the activation information is stored in a telematics unit memory device and comprises identifier information; and the task-end aspect of the modification module at the telematics unit performs the activation information modification portion of step (f) by adjusting the identifier information in the memory device.

7. The method of claim 1, wherein:

the activation information is stored in a telematics unit memory device and comprises unique characteristics information; and the task-end aspect of the modification module at the telematics unit performs the activation information modification portion of step (f) by removing of the unique characteristics information from the memory device.

8. A system to modify activation information operatively stored in a remote location, the system comprising:

a mobile computing device comprising a front-end aspect of a modification module, the mobile computing device configured to receive at least one command, the mobile computing device further configured to communicate one or more data transmissions;

a server comprising a backend aspect of the modification module, the server configured to both receive and communicate one or more data transmissions;

a telematics unit of the vehicle comprising an HMI module shown on a virtual display, the telematics unit comprising a task-end aspect of the modification module, the telematics unit further configured to receive one or more data transmissions;

wherein the front-end aspect of the modification module is configured to receive a modification command to modify the activation information from the mobile computing device, the activation information is configured to be transmitted in an activation transmission generated wherein the one or more appliances can be a garage door opener, mechanical barrier, door locking system, lighting system, alarm system, or temperature control system, wherein the activation information is represented as binary data comprising identifier information and coded key information, wherein the identifier information is configured to uniquely identify the appliance control device and is a static or dynamic serial number, wherein the coded key information has a fixed or variable code configuration, and wherein the variable code configuration is a rolling code scheme configured to generate key information by encrypting a synchronization counter value, the front-end aspect is further configured to collaborate with the mobile communicating device to transmit the modification command to the server;

wherein the backend aspect of the modification module is configured to receive the modification command from the mobile computing device, the backend aspect is further configured to collaborate with the server to transmit the modification command to the telematics unit; and wherein the task-end aspect of the modification module is configured to receive the modification command from the server, the task-end aspect is further configured to modify the activation information prior to access by the appliance control device, wherein the task-end aspect configured to exhibit a notification on the virtual display upon the activation information being modified, and wherein the task-end aspect is further configured to collaborate with the HMI module to remove one or more virtual prompts associated with the appliance control device from being displayed via the virtual display.

9. The system of claim 8, further comprising:

a user account comprising one or more pieces of validating data;

wherein the backend aspect of the modification module is configured to access the user account, the backend aspect is further configured to review the validating data to confirm vehicle accuracy.

10. The system of claim 8, wherein:

the activation information is stored in a telematics unit memory device; and the task-end aspect of the modification module is configured to modify the activation information through the adjustment of the identifier information in the memory device.

11. The system of claim 8, wherein:

the activation information is stored in a telematics unit memory device and the task-end aspect of the modification module is configured to modify the activation information through the removal of the unique characteristics information from the memory device.

12. A non-transitory and machine-readable medium having stored thereon a modification module of executable instructions to modify activation information configured to be transmitted in an activation transmission generated by an appliance control device of a vehicle, which when the medium is provided a mobile computing device, server, and telematics unit, the telematics unit comprising an HMI module shown on a virtual display, and aspects of which being executed by the mobile computing device, server, and telematics unit, causes the machines to orchestrate and perform the steps of:

(a) receiving a command to modify the activation information at the mobile computing device, the activation information confused to be transmitted in the activation transmission generated by the appliance control device of the vehicle for remote activation of one or more appliances;

(b) transmitting the command from the mobile computing device to the server;

(c) receiving the command at the server;

(d) transmitting the command from the server to the telematics unit;

(e) receiving the command at the telematics unit;

(f) modifying the activation information through the telematics unit; and (g) collaborating with the HMI module through the telematics unit to remove one or more virtual prompts associated with the appliance control device from being displayed via the virtual display.

13. The non-transitory and machine-readable medium of claim 12, further comprising:

wherein access is provided to a user account, the user account comprising one or more pieces of validating data;

(g) after step (c), accessing the user account through the server; and (h) reviewing the validating data to confirm vehicle accuracy.

14. The non-transitory and machine-readable medium of claim 12, wherein the activation information is represented as binary data comprising identifier information and coded key information.

15. The non-transitory and machine-readable medium of claim 14, wherein the coded key information has a variable code configuration.

16. The non-transitory and machine-readable medium of claim 12, wherein:

the activation information is stored in a telematics unit memory device and comprises identifier information; and the telematics unit performs the activation information modification portion of step (f) by adjusting the identifier information in the memory device.

17. The non-transitory and machine-readable medium of claim 12, wherein:

the activation information is stored in a telematics unit memory device and comprises unique characteristics information; and the telematics unit performs the activation information modification portion of step (f) by removing of the unique characteristics information from the memory device.

* * * * *